US008708264B2

(12) United States Patent
Gronvall

(10) Patent No.: US 8,708,264 B2
(45) Date of Patent: Apr. 29, 2014

(54) ROLLER CRUSHER HAVING AT LEAST ONE ROLLER COMPRISING A FLANGE

(75) Inventor: Lars Gronvall, Trelleborg (SE)

(73) Assignee: Metso Minerals (Sweden) AB, Trelleborg (SE)

( * ) Notice: Subject to any disclaimer, the term of this patent is extended or adjusted under 35 U.S.C. 154(b) by 23 days.

(21) Appl. No.: 13/451,906

(22) Filed: Apr. 20, 2012

(65) Prior Publication Data

US 2013/0277478 A1 Oct. 24, 2013

(51) Int. Cl.
*B02C 23/00* (2006.01)

(52) U.S. Cl.
USPC ..... 241/226; 241/235; 241/293

(58) Field of Classification Search
USPC ..... 241/235, 293, 300, 226
See application file for complete search history.

(56) References Cited

U.S. PATENT DOCUMENTS

| | | | | | |
|---|---|---|---|---|---|
| 753,304 | A | * | 3/1904 | Parry | 241/235 |
| 813,320 | A | * | 2/1906 | Neumann | 241/226 |
| 1,014,383 | A | | 1/1912 | Frazee | |
| 1,908,519 | A | | 5/1933 | Leonard | |
| 2,306,427 | A | * | 12/1942 | Christman et al. | 241/102 |
| 3,749,004 | A | * | 7/1973 | Pagdin et al. | 100/50 |
| 3,873,259 | A | | 3/1975 | Kennedy | |
| 5,054,701 | A | | 10/1991 | Durinck et al. | |
| 5,088,651 | A | * | 2/1992 | Takahashi et al. | 241/30 |
| 5,253,816 | A | | 10/1993 | Kastingschafer et al. | |
| 6,389,862 | B1 | * | 5/2002 | Kusters | 72/197 |
| 2010/0200686 | A1 | * | 8/2010 | Demuth et al. | 241/230 |

FOREIGN PATENT DOCUMENTS

| | | | | |
|---|---|---|---|---|
| DE | 457 037 | | 3/1928 | |
| DE | 4037816 | A1 * | 6/1992 | A47J 42/30 |
| EP | 0 328 647 | A1 | 8/1989 | |
| EP | 0 514 953 | A2 | 11/1992 | |

OTHER PUBLICATIONS

Partial European Search Report dated Oct. 2, 2012.
Partial European Search Report dated Jul. 2, 2013.

* cited by examiner

*Primary Examiner* — Faye Francis
*Assistant Examiner* — Leonel Vasquez
(74) *Attorney, Agent, or Firm* — Andrus Intellectual Property Law, LLP

(57) ABSTRACT

The disclosure relates to a roller crusher having two generally parallel rollers arranged to rotate in opposite directions, towards each other, and separated by a gap, each roller having a first end and a second end. The roller crusher includes a flange attached to at least one of the ends of one of the rollers. The flange extends in a radial direction of the roller, and has a height above an outer surface of the roller which is sufficient to extend across the gap substantially along a nip angle of the roller crusher. A feeding structure is formed on the flange and extends in an axial direction of the roller to engage material toward the gap.

9 Claims, 4 Drawing Sheets

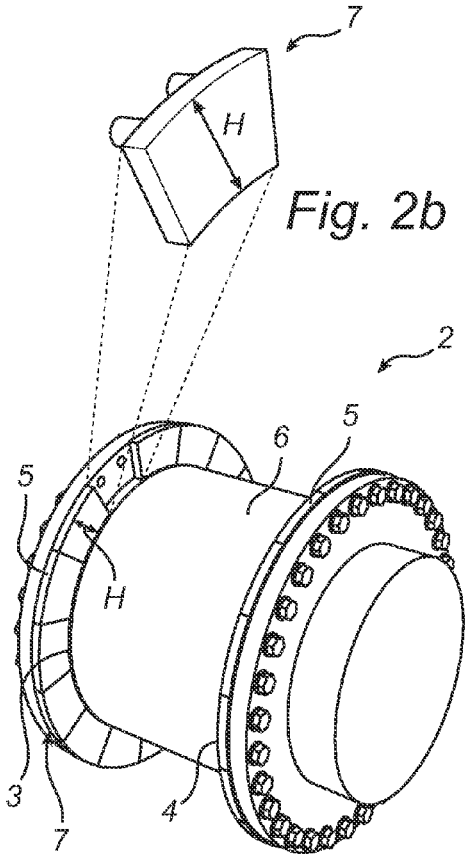
Fig. 2b
Fig. 2a
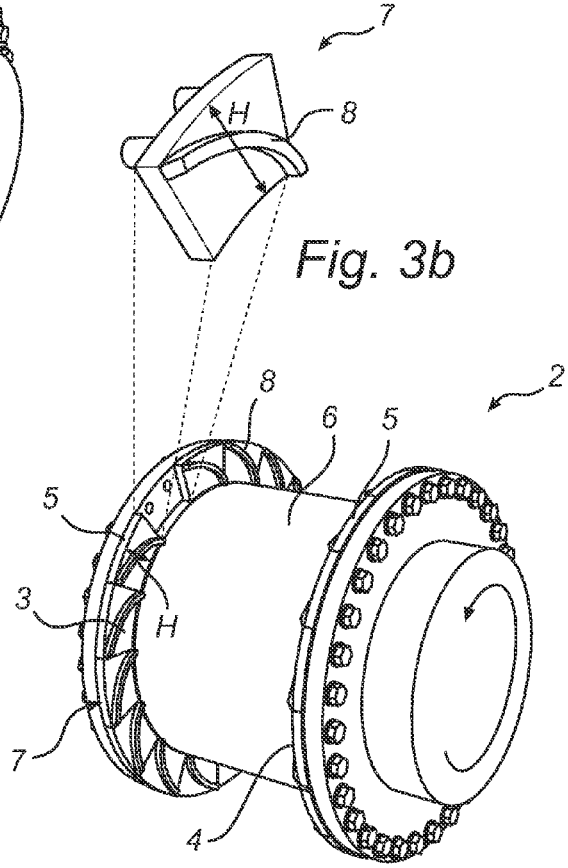
Fig. 3b
Fig. 3a

ROLLER CRUSHER HAVING AT LEAST ONE ROLLER COMPRISING A FLANGE

TECHNICAL FIELD

The invention relates to a roller crusher having two generally parallel rollers arranged to rotate in opposite directions, towards each other, and separated by a gap, each roller having a first end and a second end.

BACKGROUND ART

When crushing or grinding rock, ore, cement clinker and other hard materials roller crushers may be used having two generally parallel rolls which rotate in opposite directions, towards each other, and which are separated by a gap. The material to be crushed is fed by gravity or choke-fed into the gap. One type of roller crusher is called high pressure grinding rollers or high pressure roller crushers. This type of roller crusher uses a crushing technique called interparticle crushing. Here, the material to be crushed or pulverised is crushed not only by the crushing surface of the rolls, but also by particles in the material to be crushed, hence the name interparticle crushing.

One example of a high pressure grinding roller is described in EP-516 952. The document discloses an improved roll for a roller press capable of withstanding very high nip forces in a press nip for interparticle crushing. The roller press has a plurality of spaced wear-resistant surface members embedded in the pressing surface of the roll which are of a material harder than the material of the roll surface surrounding the inserts. By varying the size and number and material properties of the embedded pieces, the wear of the press roll is matched to the materials to be comminuted to minimize wear and to match the wear profile along the roll with extended pressing use.

A general problem associated with existing high pressure grinding rollers is that the ratio between the roller diameter and the roller width is very important due to a significant edge effect, i.e. the crushing result is reduced at the edges of the rollers. This is because of the fact that material can escape over the edges of the rollers thereby reducing the crushing pressure on the over the edges of the rollers thereby reducing the crushing pressure on the material towards the gap at the edges of the rollers. Thus, these roller parameters cannot be varied to the desired extent.

SUMMARY OF THE INVENTION

It is an object of the present invention to provide an improvement of the prior art. More particularly, it is an object of the present invention to provide a roller crusher for which the roller diameter and the roller width can be varied more freely without a reduced crushing result.

These and other objects as well as advantages that will be apparent from the following description of the present invention are achieved by roller crusher according to the following features.

A roller crusher having two generally parallel rollers arranged to rotate in opposite directions, towards each other, and separated by a gap is provided. Each roller has a first end and a second end. The roller crusher comprises a flange attached to at least one of the ends of one of the rollers. The flange extends in a radial direction of the roller, and has a height above an outer surface of the roller which is sufficient to extend across the gap substantially along a nip angle of the roller crusher. This is advantageous in that the flange eliminates the weakness spot at the edge of the rollers. The flange will help maintaining the material on the outer roller surface. That is to say, due to the flange, the material is prevented from falling over the edge of the roller. This will in turn help increasing the pressure on the material towards the gap between the rollers at the edge of the rollers. By eliminating the weakness spot at the edge of the rollers, the roller diameter and the roller width can be varied more freely without a reduced crushing result. Additionally, the flanges will facilitate the providing of an autogenous protection layer on the rollers, consisting of the material to be crushed.

The height may be sufficient to extend across the gap substantially along a nip angle of the roller crusher, when the gap is set to a maximum operational gap. The advantages mentioned above will thus be achieved at the most critical moment of the crushing operation.

The flange may comprise a feeding structure on the inside of the flange, said structure extending from the inside of the flange towards the other end of the roller. This is advantageous in that the structure will help increasing the pressure on the material towards the gap between the rollers at the edge of the roller even further. The structure will engage with the material which will be moved inside the crushing area and the pressure will be optimized.

The structure may be arcuate, continuous, intermittent, or a combination thereof. These are preferred embodiments of the structure.

The flange may be made of a first material and the structure of a second material, said second material being harder than said first material. This way, the structure will act as a wear-resistant element and protect the flange from wear. The structure will also help creating and holding an autogenous protection layer on the flange.

The flange may be divided into a plurality of segments, which is advantageous in that both the manufacturing and mounting of the flange will be facilitated. The flange may be attached to the roller by means of adhesive, bolting, screwing, welding, brazing or any other suitable fastening technique.

The roller crusher may comprise a flange attached to each end of one of said rollers, respectively. The advantages mentioned above will thus be achieved on both ends of the roller.

Generally, all terms used below are to be interpreted according to their ordinary meaning in the technical field, unless explicitly defined otherwise herein. All references to "a/an/the [element, device, component, means, etc]" are to be interpreted openly as referring to at least one instance of said element, device, component, means, etc., unless explicitly stated otherwise. Further, by the term "comprising" it is meant "comprising but not limited to" throughout the application. Lastly, the "nip angle" is defined as the angle between the horizontal plane extending through the centre of a first and a parallel second roller, and a straight line which is drawn from the centre of the first roller to and through a point on the parallel second roller, at which point an active engagement between the second roller and the material to be crushed is started. In the literature concerning this subject, two different nip angles are provided. One nip angle concerns single particle crushing, and one nip angle concerns interparticle crushing. The nip angle concerning interparticle crushing is obviously smaller than the nip angle concerning single crushing. Note that, in the present application, the nip angle concerning interparticle crushing is intended.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIG. 2*a* is a perspective view of a roller of the roller crusher having two flanges extending in a radial direction of the roller, FIG. 2*b* is a perspective view of a segment of one of the flanges in FIG. 2*a*, FIG. 3*a* is a perspective view of a roller of a roller crusher having two flanges extending in a radial direction of the roller, FIG. 3*b* is a perspective view of a segment of one of the flanges in FIG. 3*a*.

DETAILED DESCRIPTION OF PREFERRED EMBODIMENTS OF THE INVENTION

Figure 1:
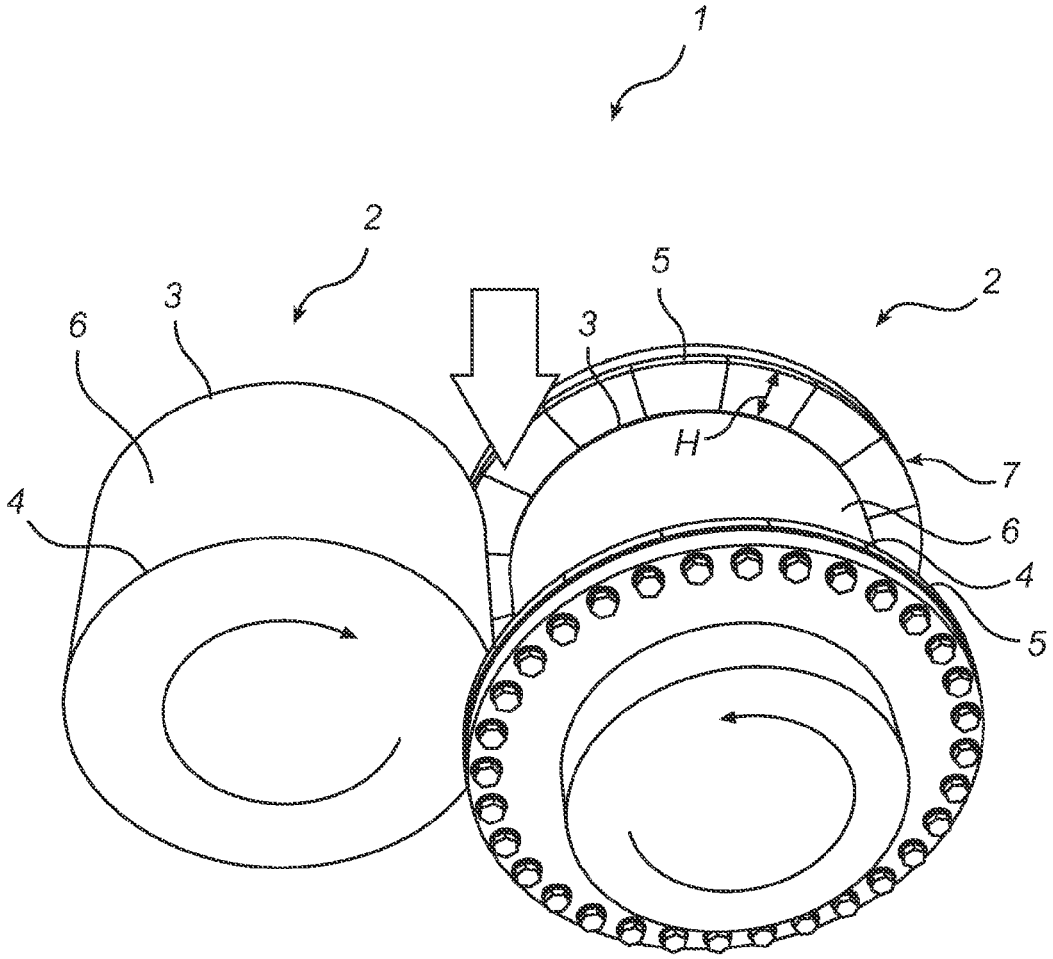
FIG. 1 is a perspective view of a roller crusher according to one exemplary embodiment of the invention.

FIG. 1 illustrates a roller crusher 1 according to one exemplary embodiment of the invention. The roller crusher 1 has two generally parallel rollers 2 arranged to rotate in opposite directions, towards each other, and are separated by a gap. Each roller 2 has a first end 3 and a second end 4. The roller crusher 1 comprises a flange 5 attached to the first and second end 3, 4 of one of the two rollers 2 of the roller crusher 1. The flanges 5 extend in a radial direction of the roller 2 and have a height H above an outer surface 6 of the roller which is sufficient to extend across the gap substantially along a nip angle α of the roller crusher 1. The height H is sufficient to extend across the gap substantially along a nip angle α of the roller crusher 1 when the gap is set to a maximum operational gap. The flanges 5 are plain and will help maintaining material to be crushed on the outer roller surface 6. That is to say, due to the flanges 5, the material is prevented from falling over the edge of the roller 2. The flanges will also facilitate the providing of an autogenous protection layer on the rollers, consisting of the material to be crushed. The flanges 5 are divided into a plurality of segments 7 in order to facilitate the manufacturing and mounting of the same. The flanges 5 are, for example, attached to the roller 2 by means of adhesive, bolting or screwing.

In FIG. 2*a*, the roller 2 of the roller crusher 1 having a flange 5 on each end 3, 4 and extending in a radial direction of the roller 2 is illustrated. The flanges 5 are plain and will eliminate the weakness spot at the edge of the rollers 2. The flanges 5 will help maintaining the material on the outer surface 6 of the rollers 2 and prevent the material from falling over the edge of the roller 2. This will in turn increase the pressure on the material towards the gap between the rollers 2 at the edge of the rollers 2.

FIG. 2*b* illustrates a segment 7 of the flange 5 in FIG. 2*a*. As stated above, the flanges 5 are divided into segments 7 in order to facilitate the manufacturing and mounting of the same. However, the flanges 5 can naturally be designed as one single unit.

In FIG. 3*a*, a second embodiment of the roller 2 of the roller crusher 1 is illustrated. Here, the flanges 5 comprise a feeding structure 8 on the inside of the flanges 5. The structure 8 extends from the inside of the flange 5 towards the other end 3, 4 of the roller 2. The structure 8 is continuous and arcuate.

The structure 8 will increase the pressure on the material towards the gap between the rollers 2 at the edge of the roller 2. The material will engage with the structure 8 and be pressured towards and through the gap, i.e. the material will be choke-fed into the gap.

FIG. 3*b* illustrates a segment 7 of the flange 5 in FIG. 3*a*. Naturally, also the flanges 5 according to this second embodiment can be designed as one single unit.

Figure 4B:
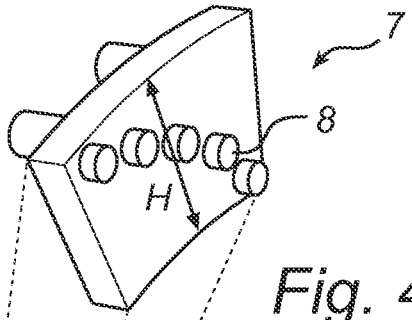
FIG. 4*b* is a perspective view of a segment of one of the flange in FIG. 4*a*.
Figure 4A:
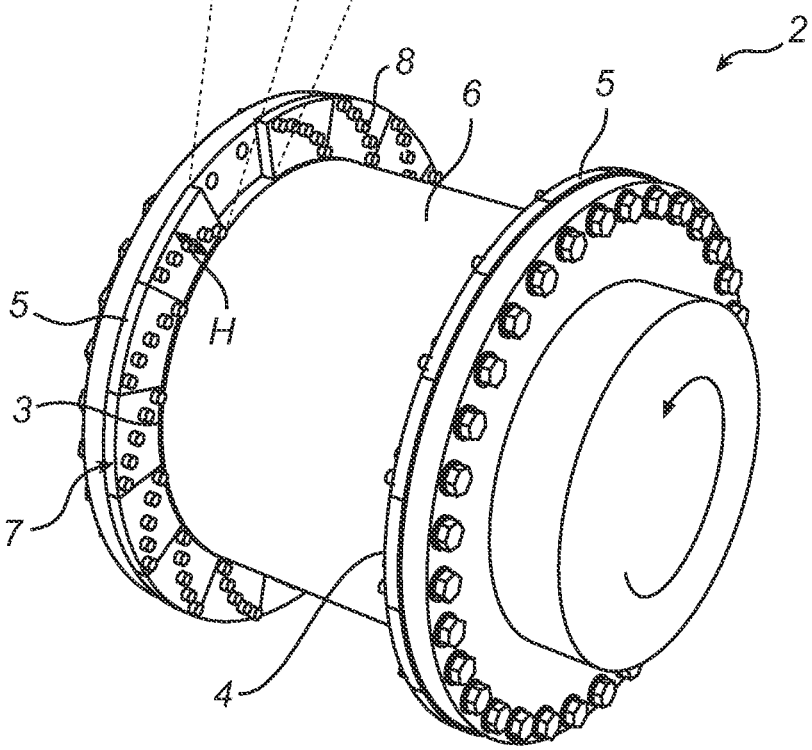
FIG. 4*a* is a perspective view of a roller of a roller crusher having two flanges extending in a radial direction of the roller.

In FIG. 4*a*, a third embodiment of the roller 2 of the roller crusher 1 is illustrated. Here, the flanges 5 also comprise a feeding structure 8 on the inside. However, the structure 8 according to this embodiment is intermittent.

FIG. 4*b* illustrates a segment 7 of the flange 5 in FIG. 4*a*. Naturally, also the flanges 5 according to this third embodiment can be designed as one single unit.

Figure 5:
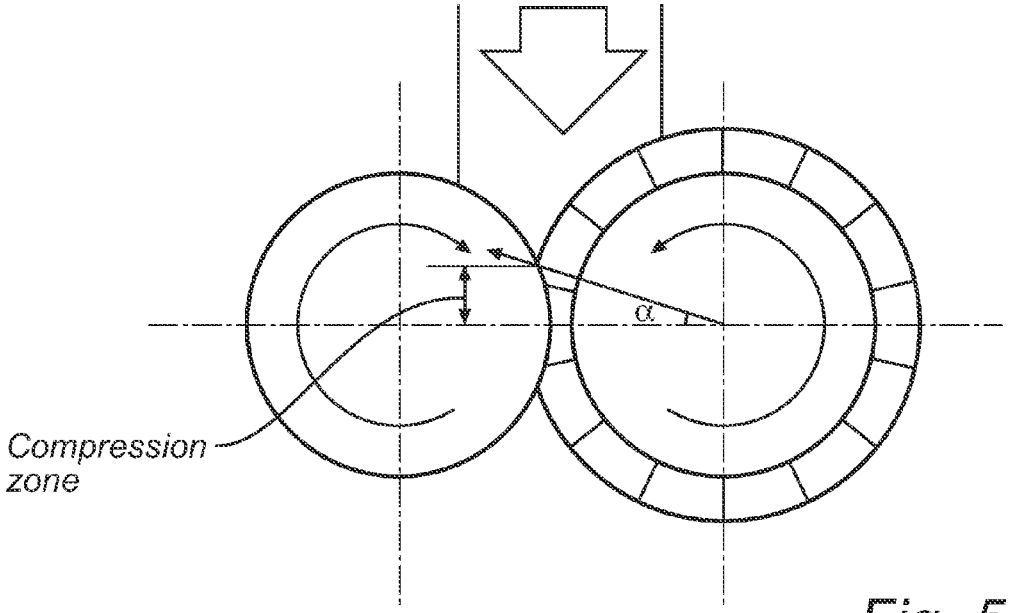
FIG. 5 is a side view of the roller crusher in FIG. 1, when having one flange only.

In FIG. 5, a side view of the roller crusher 1 is illustrated in order to facilitate the understanding of the nip angle α. A first straight line has been drawn from the centre of the right roller 2 to and through a point on the left roller 2, at which point an active engagement between the left roller 2 and the material to be crushed is started. The nip angle α is measured between the horizontal plane extending through the centre of the left and right roller, and said first straight line. It is the smaller of the two possible angles which can be obtained in accordance with the definition presented above. In the embodiment illustrated in FIG. 5, the height H of the flange 5 above the outer surface 6 of the roller 2 is sufficient to extend across the gap substantially along the nip angle α of the roller crusher 1.

During the crushing operation of the roller crusher 1, the material to be crushed is transported to the roller crusher 1 by means of a feeding arrangement and is introduced into a funnel of the feeding arrangement. The material to be crushed is then fed to the gap between the two rollers 2 of the roller crusher 1. The flange 5 of the roller crusher 1 will help maintaining the material on the outer roller surface 6 of the rollers 2 and help increasing the pressure on the material towards the gap between the rollers throughout the width of the rollers 2, especially at the edge of the rollers 2. When the material has been crushed by means of the two parallel and rotating crushing rollers 2, it travels by gravity out of gap in order to be transported from the unit.

The invention has mainly been described above with reference to a few embodiments. However, as is readily appreciated by a person skilled in the art, other embodiments than the ones disclosed above are equally possible within the scope of the invention, as defined below.

For instance, the structure may be of any suitable size and shape, for example straight, inclined, curved, ring shaped, double or single.

The size and shape of the flanges may also be varied to include a plurality of structures. If the flanges comprise a plurality of structures, these structures may be of different size and shape.

The invention claimed is:

1. A roller crusher having two generally parallel rollers arranged to rotate in opposite directions, towards each other, and separated by a gap, each roller having a first end and a second end, said roller crusher comprising:

a flange attached to at least one of said ends of one of said rollers, said flange extending in a radial direction of said roller, said flange having a height above an outer surface of said roller which is sufficient to extend across said gap substantially along a nip angle of said roller crusher, wherein said flange includes a feeding structure that extends in an axial direction of said roller from an inner surface of said flange towards the other end of said roller, wherein said feeding structure engages material to be crushed and increases pressure on said material towards said gap between said rollers.

2. A roller crusher according to claim 1, wherein said height is sufficient to extend across said gap substantially along said nip angle of said roller crusher, when said gap is set to a maximum operational gap.

3. A roller crusher according to claim 1, wherein said feeding structure is arcuate.

4. A roller crusher according to claim 1, wherein said feeding structure is continuous.

5. A roller crusher according to claim 1, herein said feeding structure is intermittent.

6. A roller crusher according to claim l, wherein said flange is made of a first material and said feeding structure is made of a second material, said second material being harder than said first material.

7. A roller crusher according to claim 1, wherein said flange is divided into a plurality of segments.

8. A roller crusher according to claim 1, wherein said flange is attached to said roller by means of adhesive, bolting, screwing, welding, brazing or any other suitable fastening technique.

9. A roller crusher according to claim 1, comprising a flange attached to each end of one of said rollers, respectively.

* * * * *